US007844388B2

(12) United States Patent
Perschl et al.

(10) Patent No.: US 7,844,388 B2
(45) Date of Patent: Nov. 30, 2010

(54) METHOD FOR REGULATING AN AIR-FUEL MIXTURE FOR AN INTERNAL-COMBUSTION ENGINE

(75) Inventors: Franz Perschl, Graefelfing (DE); Edith Heidi Dumele, Waldkraiburg (DE); Martin Buss, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 168 days.

(21) Appl. No.: 12/200,473

(22) Filed: Aug. 28, 2008

(65) Prior Publication Data

US 2009/0112441 A1 Apr. 30, 2009

Related U.S. Application Data

(63) Continuation of application No. PCT/EP2006/001816, filed on Feb. 28, 2006.

(51) Int. Cl.
*F02D 41/14* (2006.01)

(52) U.S. Cl. ..... 701/109; 123/674; 123/704; 701/103; 701/104

(58) Field of Classification Search ..... 701/103, 701/104, 109; 123/674, 704
See application file for complete search history.

(56) References Cited

U.S. PATENT DOCUMENTS

| | | | | |
|---|---|---|---|---|
| 5,544,039 | A * | 8/1996 | Hiroi | 700/31 |
| 6,287,453 | B1 | 9/2001 | Rosel et al. | |
| 6,453,229 | B1 * | 9/2002 | Ohkuma et al. | 701/109 |
| 6,619,277 | B2 * | 9/2003 | Katoh | 123/672 |
| 6,760,657 | B2 * | 7/2004 | Katoh | 701/104 |
| 2003/0065438 | A1 * | 4/2003 | Katoh | 701/104 |
| 2007/0101977 | A1 * | 5/2007 | Stewart | 123/679 |

FOREIGN PATENT DOCUMENTS

| | | | |
|---|---|---|---|
| DE | 198 44 994 | A1 | 4/2000 |
| EP | 1 279 818 | B1 | 1/2003 |
| FR | 2 749 350 | A1 | 12/1997 |
| FR | 2 749 613 | A1 | 12/1997 |
| JP | 2001-164971 | A | 6/2001 |

OTHER PUBLICATIONS

International Search Report dated Nov. 16, 2006 with an English translation of the pertinent portions (Five (5) pages).
Form PCT/ISA/220 and Form PCT/ISA/237 with an English translation of the pertinent portions (Nine (9) pages).

* cited by examiner

*Primary Examiner*—Erick Solis
(74) *Attorney, Agent, or Firm*—Crowell & Moring LLP

(57) ABSTRACT

A method of regulating the actual lambda value for an internal-combustion engine of a motor vehicle in a closed control loop is provided. A lambda setpoint is transferred to a controller for influencing an injection calculation for the internal-combustion engine, and an actual lambda value, which occurs at the output of a controlled system as a function of the injection calculation, is returned to the controller. At least one system parameter of the controlled system is determined, and the determined system parameter is transferred to a Smith predictor added to the controller for compensating the influence of the system dead time on the control loop characteristics.

18 Claims, 9 Drawing Sheets

METHOD FOR REGULATING AN AIR-FUEL MIXTURE FOR AN INTERNAL-COMBUSTION ENGINE

CROSS-REFERENCE TO RELATED APPLICATION

This application is a continuation of PCT International Application No. PCT/EP2006/001816, filed on Feb. 28, 2006, the entire disclosure of which is expressly incorporated by reference herein.

BACKGROUND AND SUMMARY OF THE INVENTION

The invention relates to a method of regulating the air-fuel mixture in the case of an internal-combustion engine of a motor vehicle in a closed control loop, where a lambda set-point is transferred to a controller for influencing an injection calculation for the internal-combustion engine. The actual lambda value, which occurs at the output of a controlled system as a function of the injection calculation, is returned to the controller.

The reduction of exhaust emissions represents a central theme in the development of modern motor vehicles. For reaching certain target values and/or for observing legally prescribed limit values for exhaust emissions, very high technical expenditures are required.

According to the state of the art, three-way catalysts are frequently used for the reduction of exhaust emissions in Otto-engine-related combustion. The three-way catalyst has its maximal conversion rate in a narrow lambda window about the stoichiometric air/fuel ratio (that is, lambda=1). A module in the engine control unit takes over the controlling and regulating of the lambda value to the optimal desired value. The entire module for the lambda control is typically constructed of several submodules. Thus, for example, dynamic effects occurring in addition to the pilot control and regulating of the lambda value are compensated, such as the build-up and reduction of the wall film. Particularly when the storage capacity of oxygen of the catalyst is reduced due to aging, a fast settling to the desired value is important for minimizing the exhaust emissions. The pilot control and other correction measures alone are not sufficient for optimally guiding the lambda value in the transient operation. The lambda control is therefore one of the most important control loops in the transmission line.

The controlled system G(s) relevant to the lambda control can be approximated by a delay element of the first order with dead time. The following can be formulated as the transfer function of the controlled system:

$$G(s) = \frac{1}{1 + T(r_L, n_{eng})s} \cdot e^{-T_1(r_L, n_{eng})s}$$

This is a non-linear system with dynamics depending on the operating point (relative air filling $r_L$, rotational engine speed $n_{eng}$) and dominant dead time $T_t$. The time constant T is characterized by the response characteristic of the broadband lambda probe (diffusion time of the oxygen molecules). The dead time is mainly but not exclusively, a function of the position of the probe in the exhaust line.

The time constants $T_t$ and T of the controlled system may change, among other things, as a result of the aging of the broadband probe and the engine model variation. The concepts of the lambda control known from the state of the art—these are usually robust controllers (such as $H_\infty$ controllers) designed offline in the frequency domain—, however, cannot take such a change into account. Thus, it cannot be ensured that the control is optimally adapted to the real controlled system under all circumstances.

In the case of most methods known from the state of the art, the parameters of the controller have to be stored in the electronic control unit as operating-point-dependent characteristic maps. They therefore occupy a very large amount of application data memory there. As a result of the control algorithm to be calculated at high expenditures, additionally much computing time is used in the electronic control unit only for the lambda control. Changes in the dimensioning of the exhaust system of an engine or motor vehicle have a direct effect on the parameters of the lambda control; that is, the determination of the control parameters has to be carried out again. Because of the high-expenditure calculation of the controller parameters, an adaptation of the parameters in the electronic control unit during the operation of the control loop is not possible. In order to ensure the stability of a system with a pronounced dead time characteristic, the control has to be designed very conservatively, which has the result that often a relatively large amount of dynamics are "given away" in the control loop characteristics. This means that, because of the design of the control, the control loop normally reacts very slowly.

It is an object of the invention, to provide a method of the above-mentioned type by which control is better coordinated with the controlled system.

According to the invention, at least one system parameter of the controlled system is determined and the determined system parameter is transferred as a parameter to a Smith predictor, which is added to the controller for compensating the influence of the system dead time on the control loop characteristic.

Preferably, the system dead time is determined and transferred as a system parameter of the controlled system. The dominating influence of the system dead time can thereby be compensated by the use of a Smith predictor. Desired system characteristics can therefore be adjusted according to the usual demands on the lambda control (emissions, movability, catalyst window).

The exhaust emissions achievable by a method according to the invention are below (or not more than on the same order of) the exhaust gas emissions of a control according to the state of the art. However, it is a significant advantage of the invention that, when the invention is applied, the consumption of resources in the electronic control unit can clearly be reduced in comparison to the state of the art.

Preferably, at least one parameter of the Smith predictor, particularly the parameter concerning the transferred system parameter (this is preferably the system dead time) can be changed online, that is, during the operation of the control loop. This advantageous further development of the invention makes it possible to optimally coordinate the control with a change of the system parameters. The system dead time or another system parameter can then be newly determined during the operating time and can be transferred to the Smith predictor. The new determination and transfer can, for example, take place continuously, quasi-continuously, at regular intervals, or in an event-controlled manner. The lambda control according to such a further development of the invention is therefore suitable to adapt itself in a self-learning manner to changed system parameters.

At least one system parameter of the controlled system, particularly the system dead time, is preferably determined by an analysis of the variation in time of the actual lambda value as a result of a forced excitation fed into the control loop. The forced excitation can particularly be modulated upon the lambda setpoint.

As known from the state of the art, the forced excitation can be calculated out of the actual lambda signal again by way of a lambda model in order not to excite the control.

In particular, the system dead time can be determined in that the time shift is determined between a signal edge of the forced excitation and a resulting change of the actual lambda value. When determining the dead time, prior knowledge is preferably utilized with respect to an expected value of the dead time. The prior knowledge may exist, for example, in the form of a range of plausible values for the system dead time. Also when determining other system parameters, such as a time constant of a PT1 member, as required, prior knowledge with respect to the system parameter to be identified may be advantageously utilized.

In particular, the system dead time concerning curve fitting algorithms or regression calculation can be computed. The determined value of the system dead time can be returned into the Smith predictor of the control and cause a model tracking there.

As another synergistic effect, the estimated or otherwise determined dead time can also be used in a lambda model. As described above, such a lambda model can be used for calculating a forced excitation out of the actual lambda signal again; that is, for generating a corrected actual lambda signal from an uncorrected actual lambda signal. Thus, in addition to the system model of the controller, the lambda model can also be tracked. In addition, the tracked lambda model can also be used for calculating the load signal by way of the injection and therefore cause the measurement by way of the hot-film air mass meter (HFM) to be eliminated.

The forced excitation is, preferably, not exclusively used for the parameter identification, particularly the identification of the system dead time, but additionally for the catalyst and lambda probe diagnosis. If a forced excitation is provided for such purposes anyhow, no additional excitation will be required. No other interference therefore has to be introduced into the system.

As required, a forced excitation existing anyhow can be modified for the purpose of parameter identification in such a manner that it continues to achieve its original purpose.

A parameter identification of at least one system parameter by analyzing a forced excitation can, in principle, also be used in the case of other model-based methods of the above-mentioned type, that is, methods that are not based on the use of a Smith predictor, and also at least partially have the above-mentioned advantages.

In principle, a system parameter identified in such a manner can also be used exclusively for the tracking of the lambda model.

Likewise, an adaptation of the parameters of a system model used in a model-based method corresponding to the present description can basically also be used in the case of other model-based methods of the above-mentioned type, that is, methods that are not based on the use of a Smith predictor, and then also at least partially has the mentioned advantages.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1A:
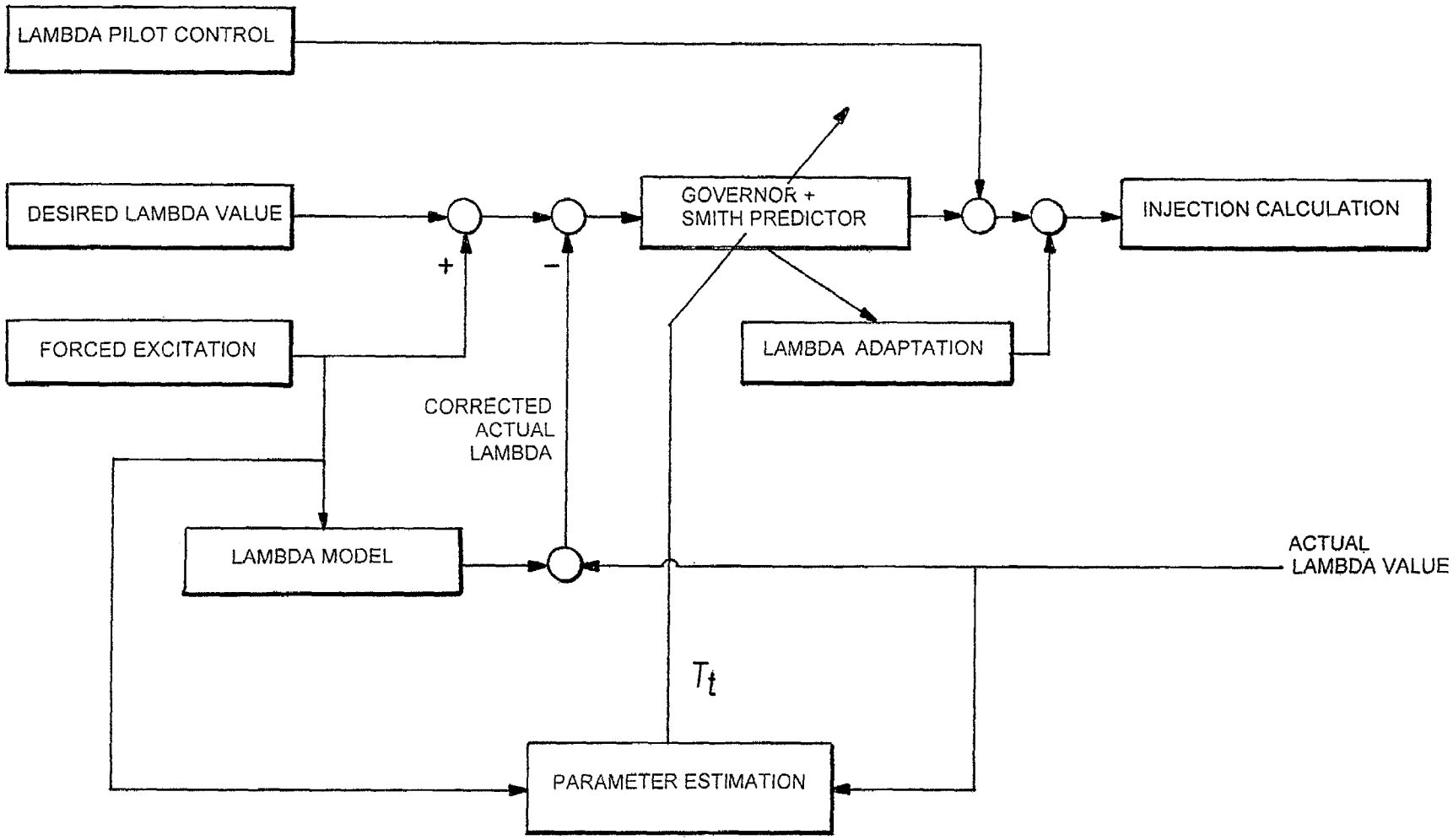
FIG. 1*a* is a block diagram of a method according to a preferred embodiment of the invention.

FIG. 1*a* illustrates a structural diagram of a method according to a preferred embodiment of the invention. The illustration in FIG. 1*a* contains the following signals and processing steps: A lambda setpoint is acted upon by a forced excitation and, minus a corrected actual lambda value, is fed into a controller with a Smith predictor. The forced excitation is also fed into a lambda model whose output is added to an uncorrected actual lambda value, which results in the corrected actual lambda value. In addition, the forced excitation and the uncorrected actual lambda value are fed into a parameter estimation. By use of the parameter estimation, a dead time $T_t$ is determined and is transferred to the controller with the Smith predictor. The controller output is acted upon by a lambda pilot control. The resulting signal is additionally acted upon by the output signal of a lambda adaptation and is transferred to an injection calculation. The lambda adaptation is primarily used for correcting the lambda pilot control. Faults in the mixture preparation can be compensated by the lambda adaptation. The lambda adaptation is particularly important when the control is not switched on; for example, in the starting phase. The faults in the mixture preparation to be compensated may be caused, for example, by air leakage, aging of the injection valves, and characteristic curve deviations in the HFM measurement. The actual lambda value measured by the sensors will then be the result of an injection carried out corresponding to the injection calculation.

During the control of the air-fuel ratio, the long system dead time occurring mainly in the range of low loads and rotational speeds present a problem. No sufficient control quality is therefore achieved by simple methods for systems having dead time (such as the Ziegler-Nichols adjustment control). It is the state of the art to use dimensioned robust controllers in the frequency domain. In addition to the tolerance with respect to a change of the system dead time, it is an advantage of these controllers that they are optimized with respect to the reference characteristic as well as with respect to the interference compensation. Control systems of a higher order are created in this case, whose order is reduced in a further step and which are adapted to the same structure for all operating points. It is a disadvantage that such methods require high expenditures with respect to computation and the control parameters cannot be tracked online with respect to changing system parameters.

Figure 1B:
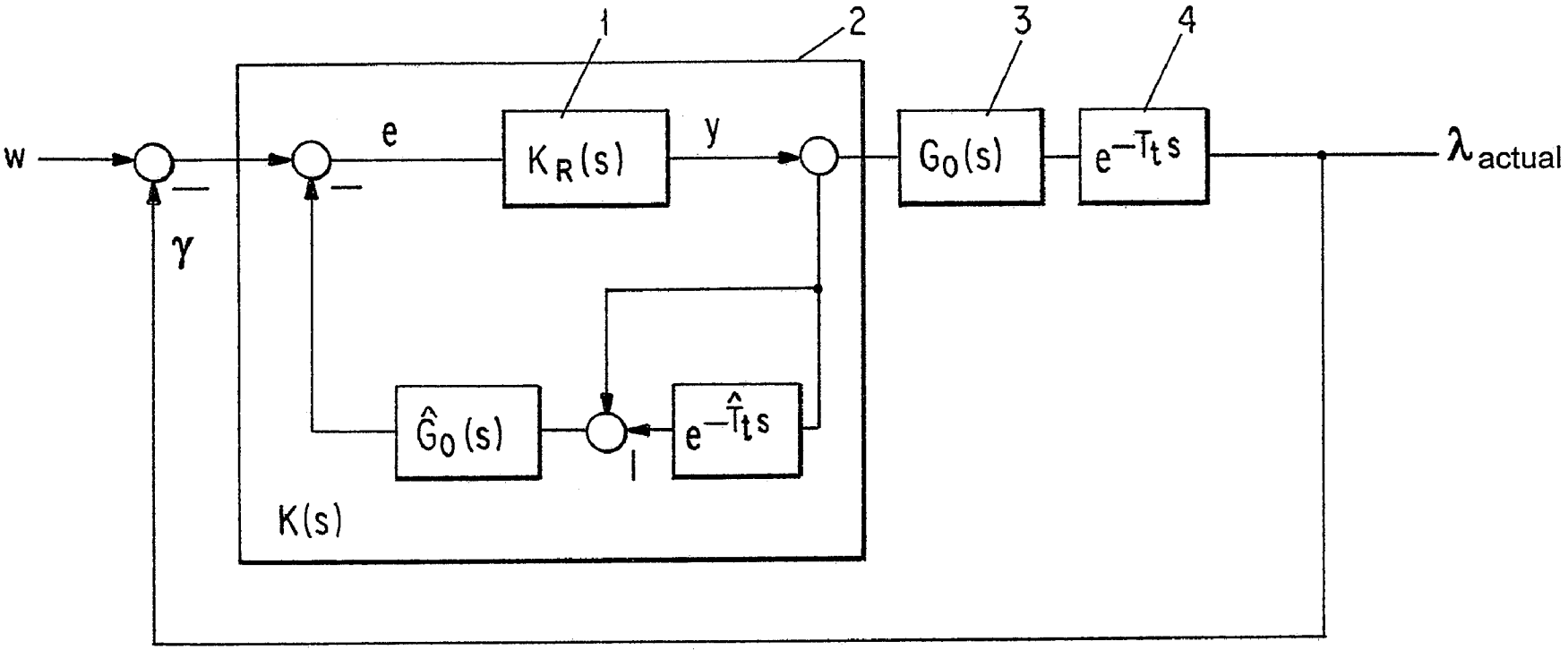
FIG. 1*b* is a diagram of the basic structure of a Smith predictor.

According to the embodiment of the invention described here, the dominating influence of the system dead time is compensated by the use of a Smith predictor. The Smith predictor was developed especially for controlled systems with dead time. FIG. 1*b* shows the basic structure of a Smith predictor. A Smith predictor is added to the controller 1 of the control loop. For this purpose, the controller output y is returned to the controller input in an appropriate manner. The controller 1 itself, together with the added Smith predictor, can also be considered to be a predictive controller 2. The "controller+Smith Predictor" block in FIG. 1*a* should also be understood correspondingly.

A predictive controller operates with an internal model $\hat{G}(s)$ of the controlled system G(s) (in FIG. 1*b* divided into a system part 3 and a dead time member 4 connected on the output side), which permits the anticipation of the effect of the control intervention on the real system. As a result, it becomes possible to design the controller for the part of the controlled system without dead time and to lay out the control less conservatively.

Although a control loop with a Smith predictor has a very sensitive reaction to changes of the actual dead time in comparison with the system dead time assumed in the system model, the robust stability of the control loop for changes of the dead time can be proven. In this case, it is assumed that a maximal change of $\Delta T_t = \pm 0.5 \cdot \hat{T}_t$ is to be expected. If the Nyquist criterion has been met for the open control circuit, the robust stability can be determined by the following equation (compare textbook: Lunze, J.: Regelungstechnik 1 (Control Engineering 1), Berlin: Springer-Verlag (2001):

$$\overline{G}_A(s) < \left|\frac{1+\hat{G}(s)K(s)}{K(s)}\right|;$$

$$\overline{G}_A(s) = |G(s)K(s) - \hat{G}(s)K(s)|.$$

The introduction of the maximal additive model uncertainty $\overline{G}_A$ into the unbalanced equation and the resolution of the unbalanced equation after $\Delta T_t$ results in:

$$\left|\frac{K(s)\hat{G}(s)}{1+K(s)\hat{G}_0(s)}\right| < \left|\frac{1}{1-e^{-\Delta T_t s}}\right|.$$

Figure 2:
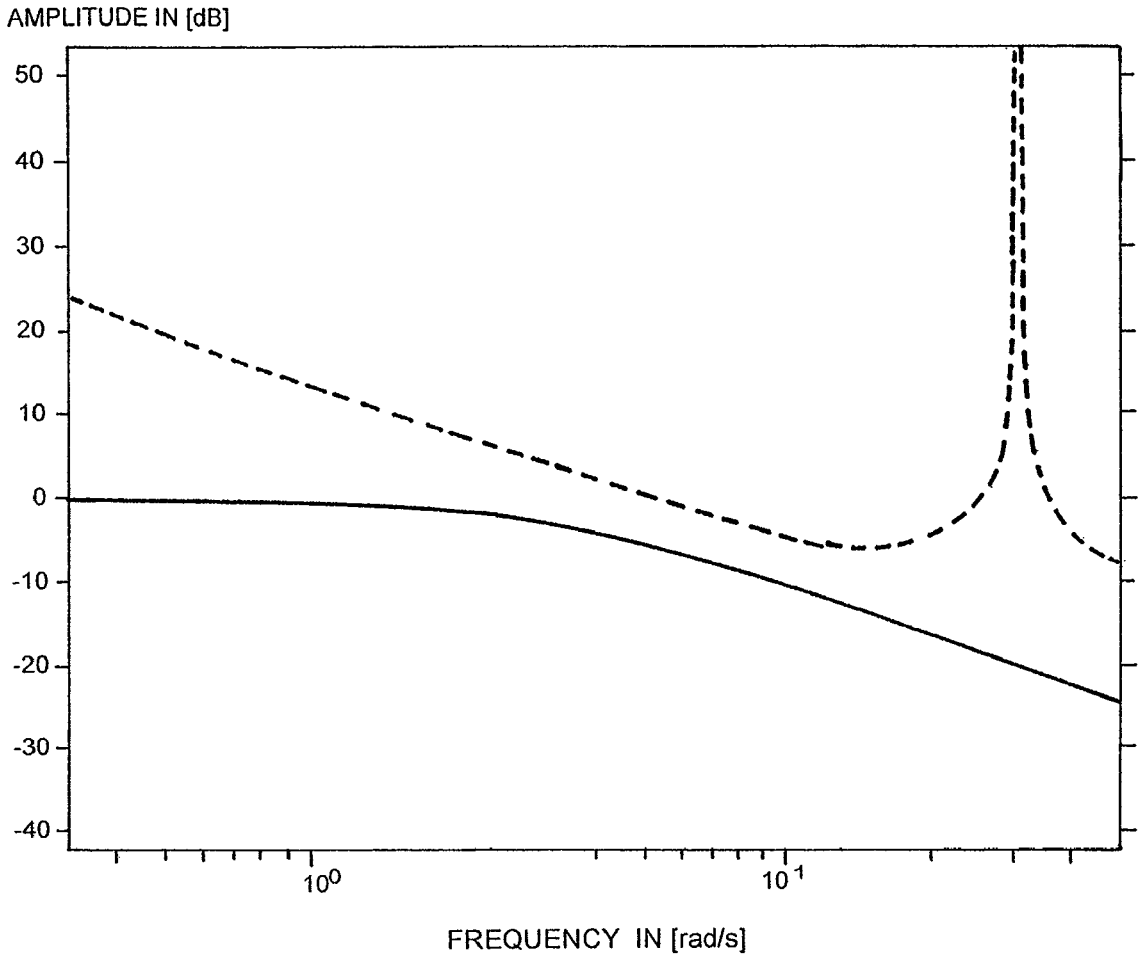
FIG. 2 is a graph of an amplitude response for checking the robust stability of the Smith predictor control loop for a deviation of the dead time of +50%
Figure 3A:
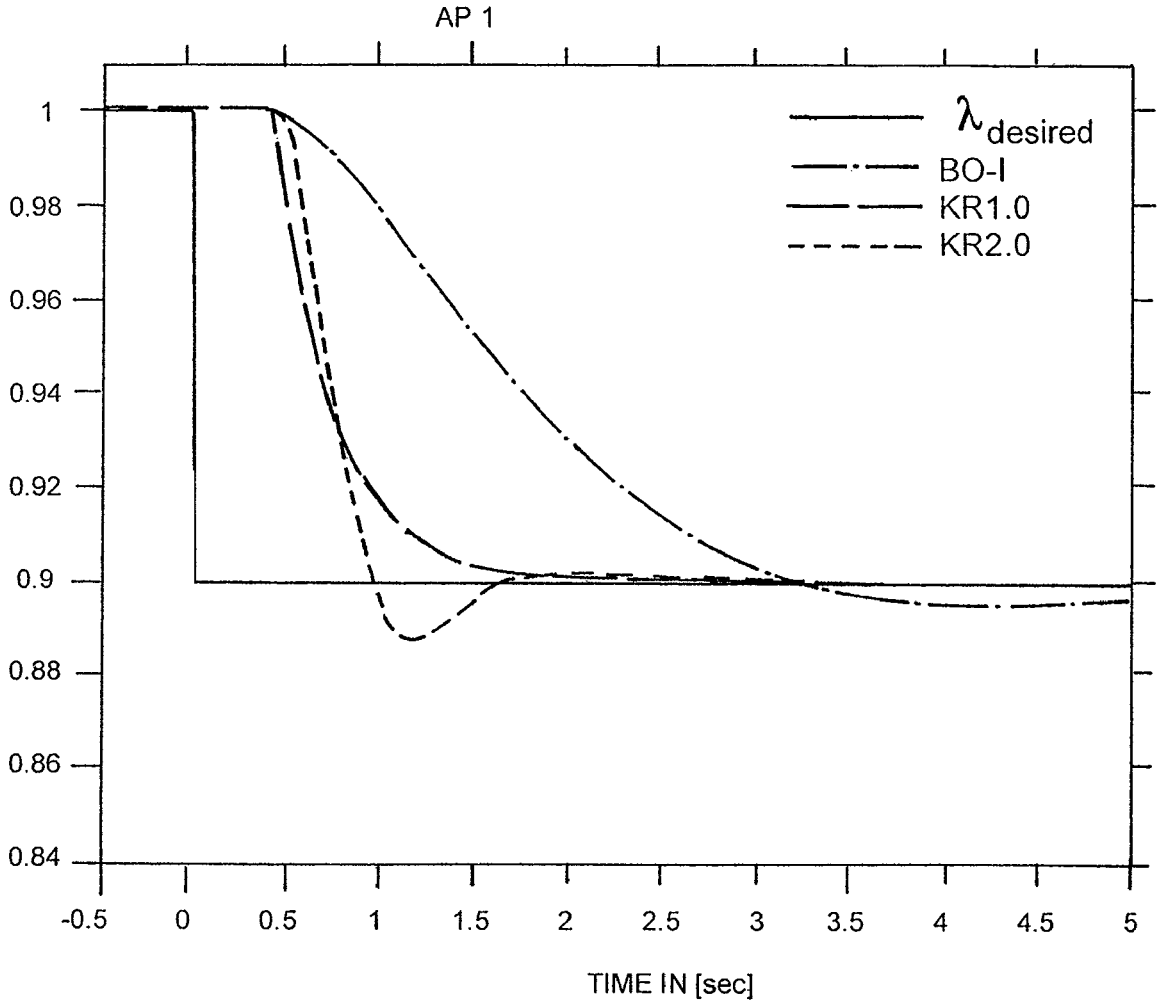
FIGS. 3*a*-3*d* illustrate graphs of the results of a simulation of the reference characteristic (FIGS. 3*a*, 3*b*) and of the disturbance compensation (FIGS. 3*c*, 3*d*); AP1=(20%, 1,000 r.p.m.) (FIGS. 3*a*, 3*c*), AP2=(60%, 4,000 r.p.m.) (FIGS. 3*b*, 3*d*)
Figure 3B:
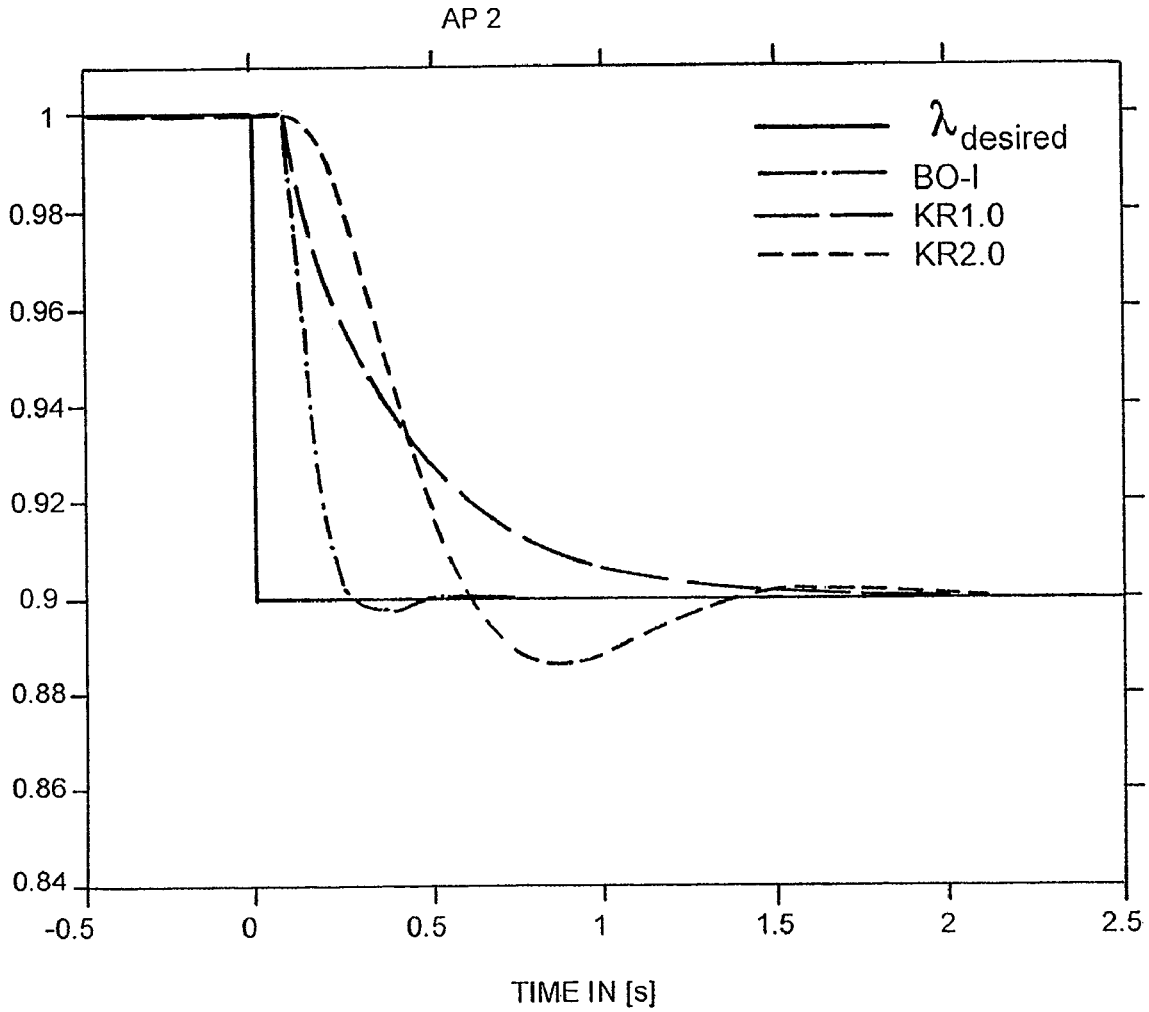
Figure 3C:
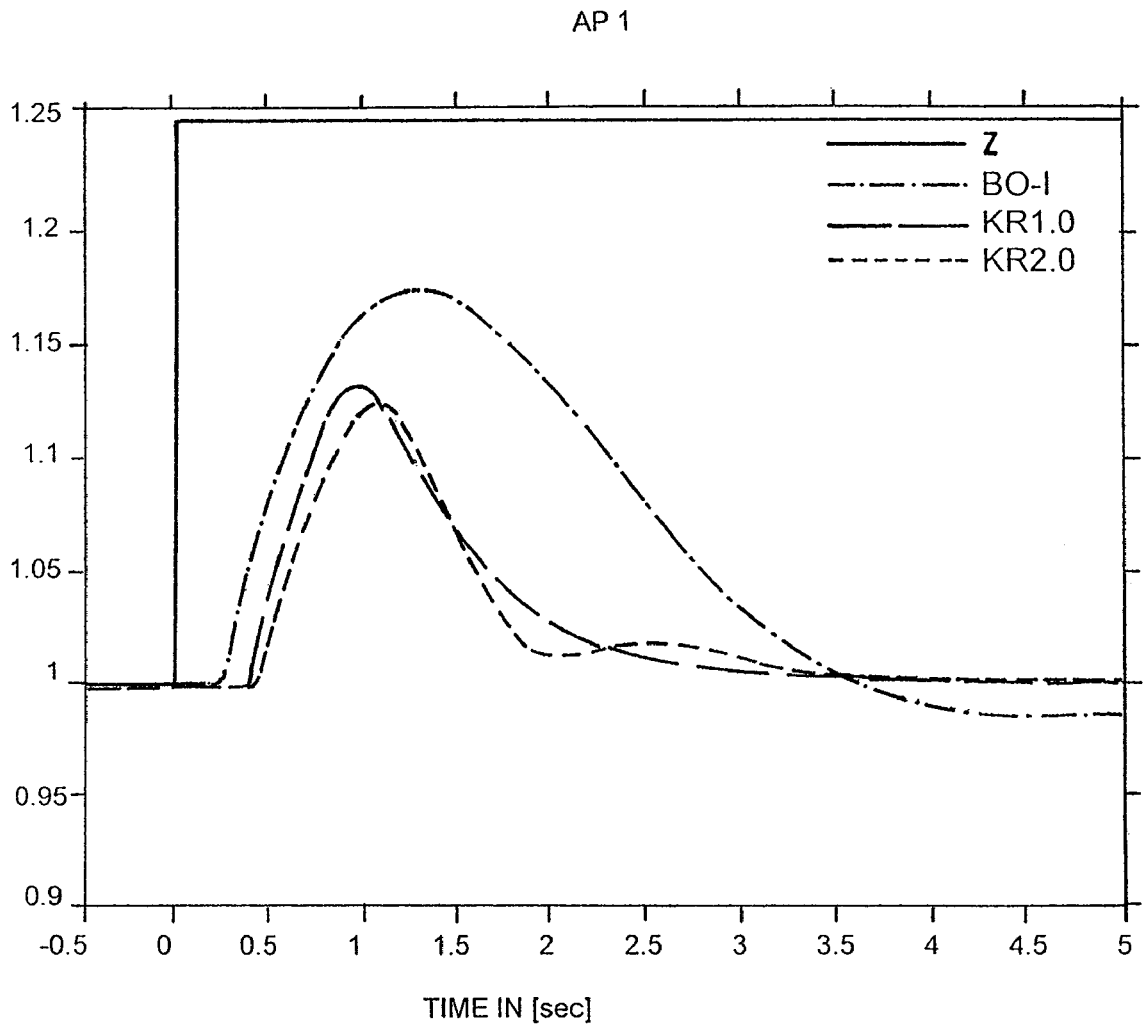
Figure 3D:
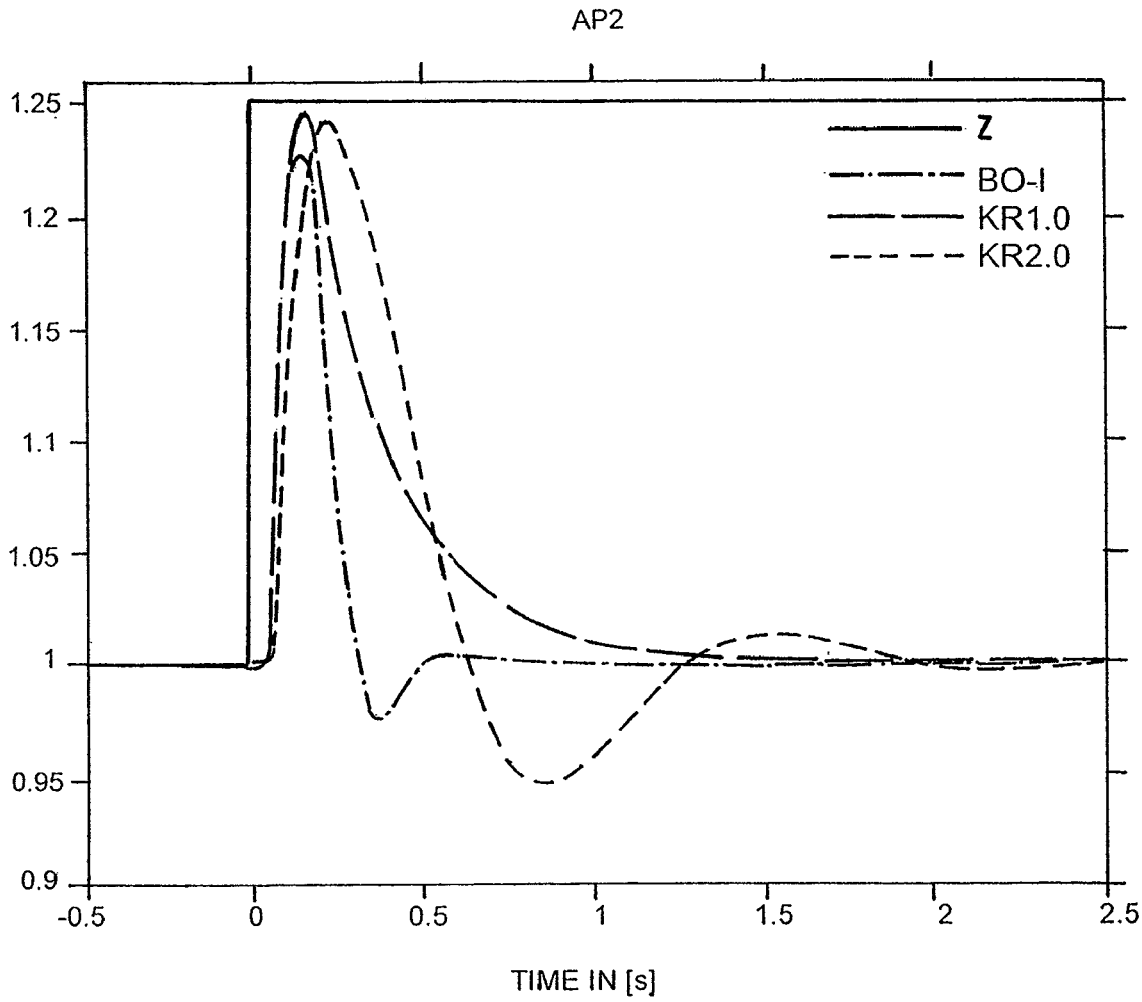

FIG. 2 illustrates the solution of the right side (solid line) and of the left side of the unbalanced equation (dotted line). The robust stability is ensured for all cases in which the curves do not touch one another. The robust stability was examined in this manner for different controllers, particularly the controllers considered here, $K_R(S)$, and the operating points.

When the controlled system is known, a controller can be determined such that the system is compensated in the controller and the new transfer function of the closed control loop shows a desirable transfer characteristic M(s). Here, it is a required condition for the controlled system to be stable. The following applies to the compensation controller:

$$K_R(s) = \hat{G}^{-1}(s) \cdot \frac{M(s)}{1-M(s)}$$

As a result of the Smith predictor, with $\hat{G}_0 = G_0$ for the open control circuit, the following transfer function is obtained:

$$F_0(s) = \frac{M(s)}{1-M(s)}.$$

The transfer characteristic of the closed control loop is M(s) delayed by the dead time.

For proving the advantages as well as the implementability of the invention, several simulation results obtained by using the invention will be introduced in the following.

Several controller designs $K_R(S)$ were examined by use of a Matlab/Simulink simulation model. The characteristics of the closed control loop when excited by a reference or disturbance jump are illustrated in FIG. 3. Since the system parameters vary considerably as a function of the operating point, two characteristic operating points are selected here in which the dead time changes by a factor of ten. The two upper graphs show the result of a simulation of the reference characteristics; the two lower graphs show the interference compensation. The two left graphs relate to an operating point AP1=(20%, 1,000 r.p.m.); the two right graphs relate to an operating point AP2=(60%, 4,000 r.p.m.).

The lambda control is basically a fixed set-point control. However, desired-value changes also occur because of different electronic control unit functions (such as an active catalyst diagnosis). In the case of a reference value jump, the closed control loop should have a maximal settling time of one second. FIG. 3 illustrates that the controller, which was adjusted according to the absolute value optimum (BO-I), does not always meet this demand. The compensation controllers of the $1^{st}$ and $2^{nd}$ order (KR1.O and KR2.O respectively) were dimensioned such that they meet this requirement.

However, the compensation controller of the 2nd order has the greater damping in the event of an excitation with an interference jump. In the simulation, the controller parameters are constant for all operating points. Here, operating-point-dependent control parameters would result in an additional gain in control quality.

According to a further development of the invention, the parameters of the system model stored in the Smith predictor can be adapted online. Although this is not absolutely necessary because of the results of the implemented robustness analysis, it makes it possible to particularly react in an improved manner to slow changes of the controlled system.

In order to be able to adapt the dead time of the system model, the dead time of the control loop can be estimated online from an observation of the reaction of the controlled system to a forced excitation modulated onto the lambda setpoint.

Figure 4:
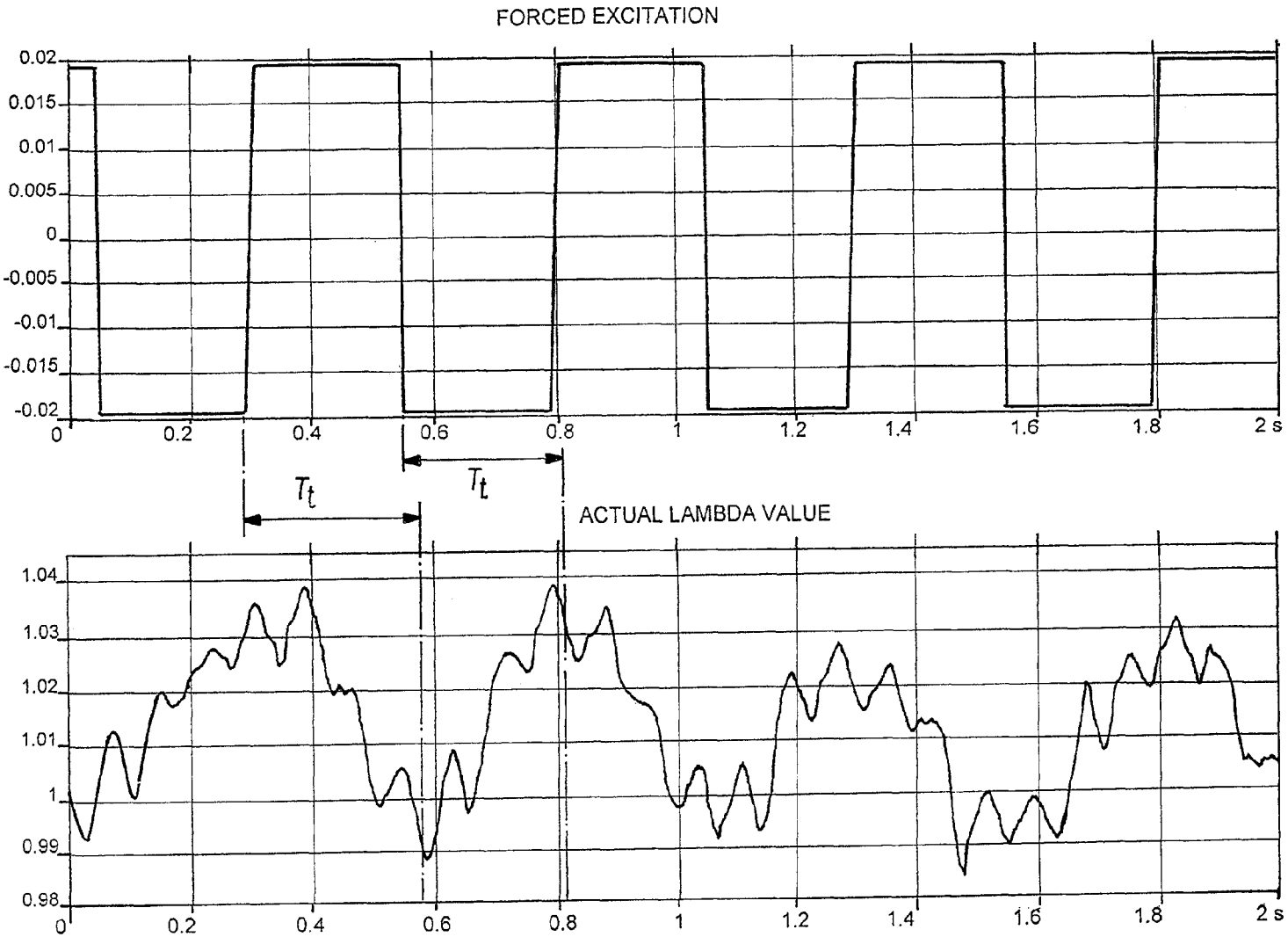
FIG. 4 is a graph of the forced excitation fed into the control loop and of the resulting actual lambda value.

FIG. 4 shows a forced excitation introduced for this purpose into the control loop (FIG. 4 above) and the resulting actual lambda value (FIG. 4 below).

Providing a forced excitation is known from the state of the art for the purpose of the catalyst and lambda probe diagnosis. The forced excitation therefore does not have to be provided especially for the purposes of the invention, but rather the forced excitation present in any event can be utilized. Therefore, no additional interference has to be introduced into the control loop. In the present case, as known from the state of the art, the forced excitation is calculated out of the actual lambda signal again by way of the lambda model (compare FIG. 1*a*) in order not to excite the control.

The effect of the dead time on the measured actual lambda signal is indicated in FIG. 4 by vertical reference lines and arrows: In the case of a modulation of the lambda setpoint by +2%, the actual lambda value moves in the "lean" direction only after a short dead time $T_t$ has passed. A corresponding situation applies to a jump of the desired value by −2% in the "rich" direction.

Since there is a relatively strong interference with the lambda signal, low-pass filtering is carried out first. Subsequently, the preceding sign of the signal gradient is determined. Under ideal conditions, this should result in a square wave signal shifted by the dead time analogous to the forced excitation. However, in reality, only approximately 10% of all signal edges can be evaluated in this manner. The determination of the usable edges takes place by a comparison with the expected signal edge on the basis of the known dead time. Since it is a prerequisite that the dead time changes slowly, a window of a few scanning values (2-3, corresponding to 20-30 ms) can be opened up around the expected value. If the signal edge is within this window, the stored parameter value can be adapted for the dead time. Thus, when determining the dead time, prior knowledge is used with respect to an expected value of the dead time.

If the dead time is determined for a measuring value, also the time constant T can be determined from the measured values of the lambda signal. For this purpose, a curve-fitting can be used by means of an e-function or the calculation can be used by way of a straight regression line. In addition, the found values for the time constant can be filtered again by means of the stored values over an expectation interval.

In a last step, the time constants, which were determined for an arbitrary operating point, are assigned to the supporting points of the characteristic maps stored in the engine timing unit.

In addition to the above-described simulation results, several practical results obtained while using the invention are introduced in the following for proving the advantages as well as the implementability of the invention.

The method suitable for the online use was tested by a Rapid Control Prototyping System.

Figure 5A:
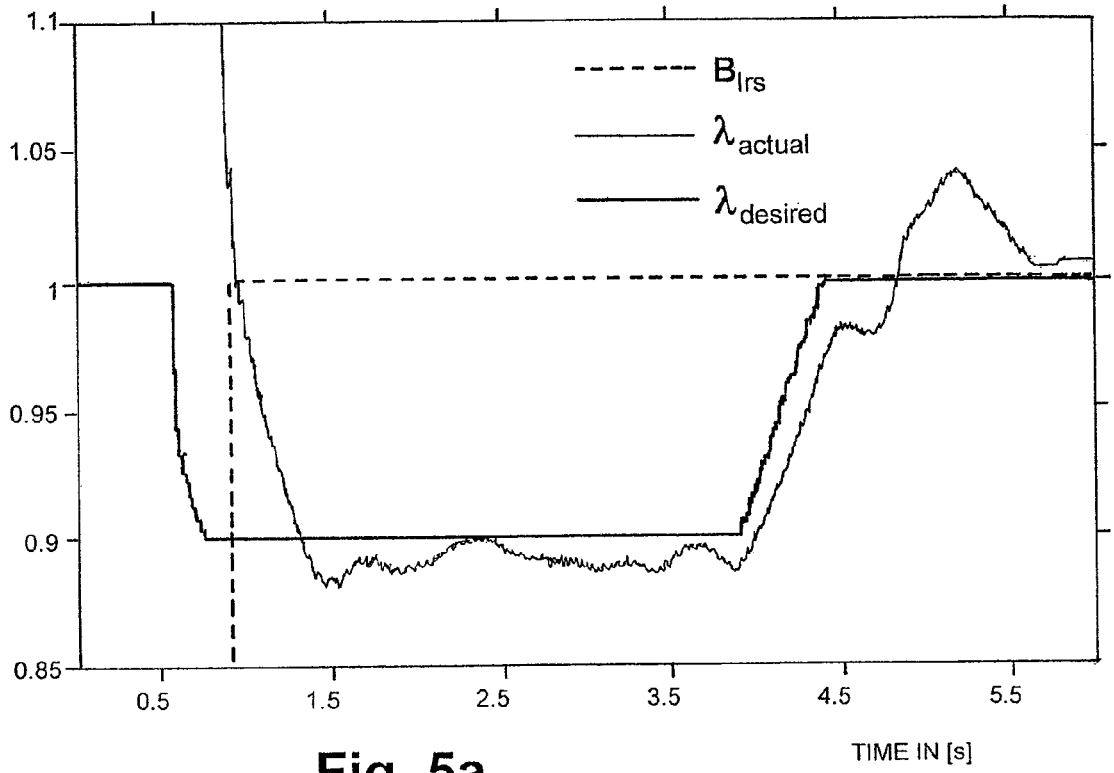
FIGS. 5*a*, 5*b* are graphs of the transient response after a fuel cut-off in the overrun in operating point AP=(50%, 2,000 r.p.m.) for a controller of a series-produced engine timing gear (FIG. 5*a*) and a compensation controller of the second order (FIG. 5*b*) according to the invention.
Figure 5B:
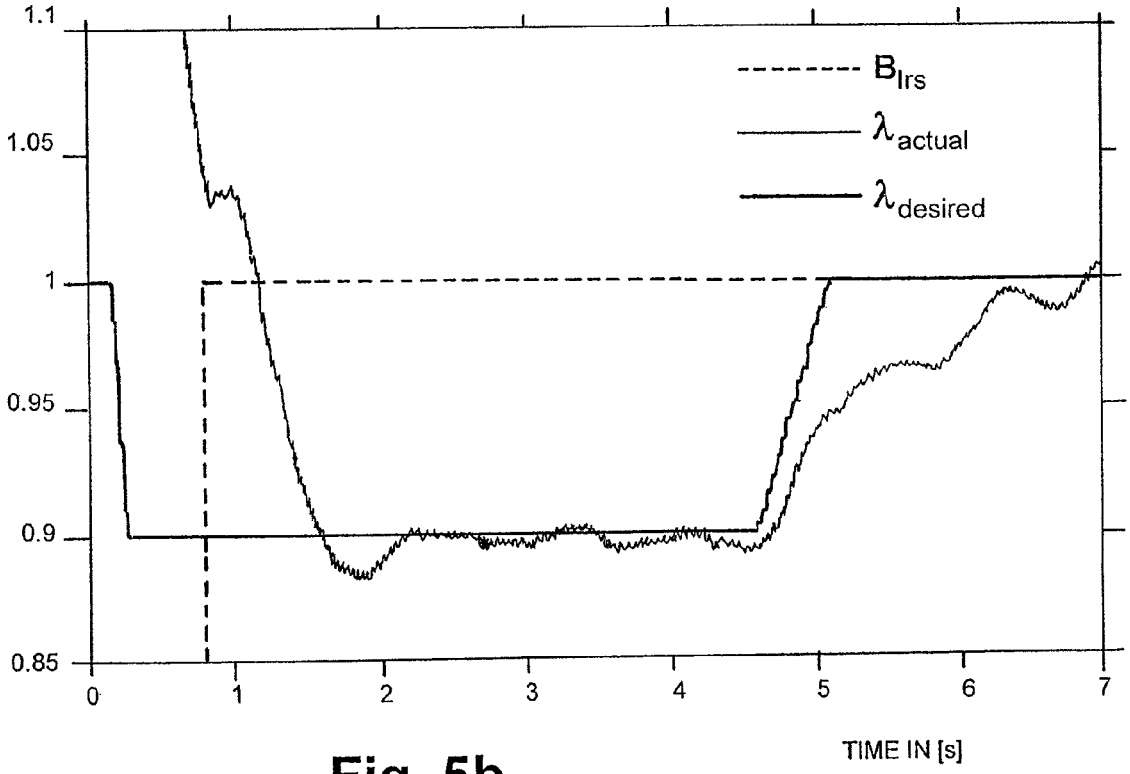

The control method according to the invention was compared in the driving operation with a control method according to the state of the art (series-produced controller) with respect to the interference compensation, the subsequent characteristics, and the transient response after the activation of the controller. The two controls qualitatively have similar characteristics. In FIGS. 5*a* and 5*b*, the measured transient response is illustrated as an example.

FIG. 5*a* relates to the series-produced controller; FIG. 5*b* relates to a compensation controller of the 2nd order according to the invention. The two figures show the transient response after a fuel cut-off in the overrun in the operating point AP=(50%, 2,000 r.p.m.) in each case entered over time. The broken line represents the switch-on condition for the lambda control; the line with hash marks represents the actual lambda value; and the solid line represents the lambda setpoint.

For evaluating the control quality, several exhaust gas cycles were run on a roller-type test stand. A comparison of the measured exhaust gas emissions between the series-produced controller and the compensation controller of the $2^{nd}$ order according to the invention shows that the predictive control according to the invention has a quality which is comparable with the quality of the robust series-produced controller at minimal parameterizing expenditures of the constant control parameters.

The individual results of the exhaust gas test for the compensation controller of the 2nd order according to the invention are:

HC[Δ%]: +3
CO[Δ%]: +5
$NO_x$[Δ%]: −14
$b_e$[Δ%]: <+1

Summarizing, the invention permits a controlling of the air-fuel ratio at very low parameterizing expenditures, and nevertheless supplies results comparable with control concepts according to the state of the art requiring significantly higher computing expenditures. In addition, a further development of the invention permits an adaptation of the lambda control to changing system parameters.

According to a further development of the invention, an operating point-dependent parameterization of the controller may also take place for an additional gain of quality. The parameterizing can take place within the time range and is connected with considerably lower expenditures than a parameterizing according to the state of the art.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method of regulating an air-fuel mixture in an internal-combustion engine of a motor vehicle in a closed control loop, wherein a lambda setpoint is acted on by a forced excitation and then transferred to a controller for influencing an injection calculation for the internal-combustion engine, and an actual lambda value, which occurs at an output of a controlled system as a function of the injection calculation, is corrected based at least in part on the forced excitation and then returned to the controller, the method comprising the act of:

determining at least one system parameter of the controlled system; and transferring the determined system parameter to a Smith predictor added to the controller for compensating the influence of system dead time on control loop characteristics of the closed control loop.

2. The method according to claim 1, wherein a system dead time is determined as a system parameter of the controlled system.

3. The method according to claim 1, wherein at least one parameter of the Smith predictor is changeable during the operation of the control loop.

4. The method according to claim 3, wherein the changeable parameter is the transferred determined system parameter.

5. The method according to claim 1, wherein at least one system parameter of the controlled system is determined by an analysis of a variation in time of the actual lambda value as a result of a forced excitation fed into the control loop.

6. The method according to claim 3, wherein at least one system parameter of the controlled system is determined by an analysis of a variation in time of the actual lambda value as a result of the forced excitation fed into the control loop.

7. The method according to claim 2, wherein the system dead time is determined by an analysis of a variation in time of the actual lambda value as a result of the forced excitation fed into the control loop.

8. The method according to claim 3, wherein the system dead time is determined by an analysis of a variation in time of the actual lambda value as a result of a forced excitation fed into the control loop.

9. The method according to claim 5, wherein the forced excitation is used in addition to a catalyst and lambda probe diagnosis.

10. The method according to claim 7, wherein the forced excitation is used in addition to a catalyst and lambda probe diagnosis.

11. The method according to claim 5, wherein the forced excitation is calculated out of the actual lambda value again by way of a lambda model.

12. The method according to claim 7, wherein the forced excitation is calculated out of the actual lambda value again by way of a lambda model.

13. The method according to claim 1, wherein the forced excitation is calculated out of the actual lambda value again by way of a lambda model.

14. The method according to claim 9, wherein the forced excitation is calculated out of the actual lambda value again by way of a lambda model.

15. The method according to claim 1, wherein prior knowledge concerning an expected value of the system dead time is utilized in the determination of the system dead time.

16. The method according to claim 2, wherein prior knowledge concerning an expected value of the system dead time is utilized in the determination of the system dead time.

17. The method according to claim 3, wherein prior knowledge concerning an expected value of the system dead time is utilized in the determination of the system dead time.

18. A method of regulating an air-fuel mixture in an internal-combustion engine of a motor vehicle in a closed control loop, the method comprising the acts of:

detecting an uncorrected actual lambda value at an output of a controlled system, wherein the uncorrected actual lambda value is a function of the injection calculation;

correcting the uncorrected actual lambda value based at least in part on a forced excitation;

modulating a forced excitation upon a lambda setpoint;

transferring the modulated lambda setpoint, minus the corrected actual lambda value, to a controller configured to perform an injection calculation for the internal-combustion engine;

determining a system dead time by an analysis of a variation in time of the uncorrected actual lambda value resulting from the forced excitation fed into the control loop; and transferring the system dead time to a Smith predictor added to the controller for compensating the influence of system dead time on control loop characteristics of the closed control loop.

* * * * *